United States Patent [19]

Kaneko

[11] 4,350,262

[45] Sep. 21, 1982

[54] EASY-OPEN CAN CAP WITH A RING PULL TAB

[75] Inventor: Shunji Kaneko, Ebina, Japan

[73] Assignee: Toyo Seikan Kaisha, Ltd., Tokyo, Japan

[21] Appl. No.: 192,974

[22] Filed: Oct. 2, 1980

[30] Foreign Application Priority Data

May 21, 1980 [JP] Japan ..... 55-68794[U]

[51] Int. Cl.[3] ..... B65D 17/34

[52] U.S. Cl. ..... 220/273

[58] Field of Search ..... 220/269–273

[56] References Cited

U.S. PATENT DOCUMENTS 3,315,837 4/1967 Boik et al. ..... 220/273

3,682,350 8/1972 Baugh et al. ..... 220/273

*Primary Examiner*—George T. Hall

*Attorney, Agent, or Firm*—Jordan and Hamburg

[57] ABSTRACT

An easy open can cap has an elongated tear strip defined by a main score and a ring pull tab attached to the tear strip by a rivet. A bending score is provided on the tear strip near the rivet, the bending score extending perpendicular to a longitudinal extending center line of the tear strip so that when the ring pull tab is initially lifted, the tear strip bends at the bending score to thereby reduce the applied force necessary for initiating opening of the tear strip. The main score has a starting end portion extending partially around the area of said rivet and a terminating end portion at the opposite end of the tear strip, the main score having a transitional portion between the starting end portion and the terminating end portion with the transitional portion having a thinner score residual than that of the starting end portion.

8 Claims, 19 Drawing Figures

EASY-OPEN CAN CAP WITH A RING PULL TAB

BACKGROUND OF THE INVENTION

This invention relates to an improvement of an easy-open can cap with a ring pull tab and with a deformed ellipse-shaped tear-opening portion scored on the cap surface, for a variety of drinking cans made of tinned or tin-free steel plates.

In such a conventional easy-open can cap (30) with a ring pull tab as shown in FIG. 1, after charging the can with a drinking liquid the air in the head space is removed and the can cap (30) is seamed and sealed to a can body (32) under reduced pressure, the cap surface (34) as a whole bends downwardly while describing a gentle circular arc as is shown in FIG. 2.

However, when subjected to heating in the sterilizing step after sealing, the cap surface (34) as a whole bends upwardly while describing a gentle configuration because of an increase in the internal pressure as is illustrated in FIG. 3. As a result, a ring pull tab (42), which is riveted with a rivet (36) to a tear-opening portion (38) in an approximately central portion of the can cap (30) and which extends near a seam band (40), rises highest at the position of the rivet (36) as is illustrated in FIG. 3 due to the upward bending of the cap surface (34). Also a finger hook (44) of the ring pull tab (42) rises higher than the seam band (40) until the can body (32) is again reduced in pressure and this causes difficulties in the conveyance of cans, for example, the finger hook (44) will be hooked to the conveyor.

When the can body (32) is cooled and again reduced in pressure after the sterilizing process, the can surface (34) bends downwardly as is illustrated in FIG. 2, so that the centrally located rivet (36) assumes the lowest position, and the riveted ring pull tab (42) also goes down so the finger hook (44) approaches the cap surface (34), resulting in that, when opening the can, not only it is difficult to insert a finger in the finger hook (44) but also the nail tip may be damaged.

In the conventional can cap (30) of this sort as shown in FIG. 1, the opening operation for the tear-opening portion (38) which is scored in the form of a deformed ellipse on the cap surface (34) with a score (46), is begun with the initial opening (score break) operation (see FIG. 5) in which the finger hook (44) of the ring pull tab (42) is pulled up with a finger (see FIG. 4) and is then pivotally moved with both side fulcrum ends (48*a*) and (48*b*) of the ring pull tab (42) as fulcrums to thereby break a small-diameter semicircle portion (46*a*) of the score (46), then the operation shifts to the second opening (score tear) operation in which the ring pull tab (42) is pulled up with a nose portion (50) as a fulcrum (see FIG. 6) and the tear-opening portion (38) is torn and opened along with both sides straight-line portions (46*b*) and (46*c*) of the score (46).

In the can cap (30) of this sort, as is illustrated in FIG. 7, since the score (46) is stamped to form the tear-opening portion (38), the latter portion becomes outwardly convexed due to the plastic flow phenomenon of the surplus metal at the time of the stamping operation and thus a ridge portion (52) is formed in the axial larger diameter direction of the tear-opening portion (38).

In the tear-opening portion (38) having such ridge portion (52) in the axial larger diameter direction thereof, when one tries to effect the initial opening operation in the small-diameter semicircle portion (46*a*) with the fulcrum ends (48*a*) (48*b*) as fulcrums, it is difficult to bend the tear-opening portion (38) because of the existence of rigidity in the opening direction created by the ridge portion (52) of the tear-opening portion (38). For this reason, as is shown in FIG. 5, an initial opening area (W) becomes large and a force as large as 2.0 to 3.0 kg. is required to cause the initial breakage, which not only produces pain in the finger tip but also sometimes makes it impossible for women and children to open the can.

Besides, due to the relation between the depth of the score (46) and crack in tinned or tin-free steel plates, the ordinary stamping operation has a restriction such that the score residual can be only about 60–70$\mu$ at most.

As a result, when opening the tear-opening portion (38) of the drinking can easy-open cap (30) with the ordinary standard ring pull tab (42), the opening operation requiring the maximum opening force concentrates on the second opening operation, particularly at the beginning thereof, as is shown in FIG. 8; in other words, as compared with the breaking force as large as 2.0 to 3.0 kg. required for the initial opening operation, the tear starting force in the second opening operation reaches an even larger value of at least 3.0 to 5.0 kg.

In the easy-open can cap of this invention with a ring pull tab riveted in a small-diameter semicircle portion of a tear-opening portion which is defined on the cap surface by a deformed ellipse-shaped score, a score is formed perpendicular to the axial larger-diameter direction of the said tear-opening portion and in the vicinity of a circular arc-shaped nose portion of the ring pull tab, and further the score residual in a predetermined transitional area from where the second opening operation is started by pulling up the ring pull tab after the small-diameter semicircle portion was broken by the initial opening operation until where the second opening operation becomes stable, is made smaller than the score residual at least in the said small-diameter semicircle portion.

It is an object of this invention to provide an easy-open can cap with a ring pull tab whereby the opening operation for a tear-opening portion defined on the cap surface by a deformed ellipse-shaped score can be started smoothly at a reduced initial opening force without causing breakage or coming-off of the tab.

It is another object of this invention to provide an easy-open can cap with a ring pull tab whereby the transitional tearing operation can be done smoothly with reduced second opening force halfway in the opening operation for the tear-opening portion defined on the cap surface by a deformed ellipse-shaped score.

It is a further object of this invention to provide an easy-open can cap with a ring pull tab whereby a finger can be inserted smoothly in the finger hook of the ring pull tab to pull up the latter no matter at what pressure the can interior may be.

It is another object of this invention to provide an easy-open can cap with a ring pull tab in which even when the interior of the can is at a positive pressure the finger hook of the ring pull tab does not project above the seam band between the can cap and the can body so the finger hook can be prevented from being hooked to the conveyor etc. during conveyence of the can.

Other and further objects of this invention will becomes apparent from the description of the specification and the drawings.

DESCRIPTION OF THE PREFERRED EMBODIMENTS

Figure 9:
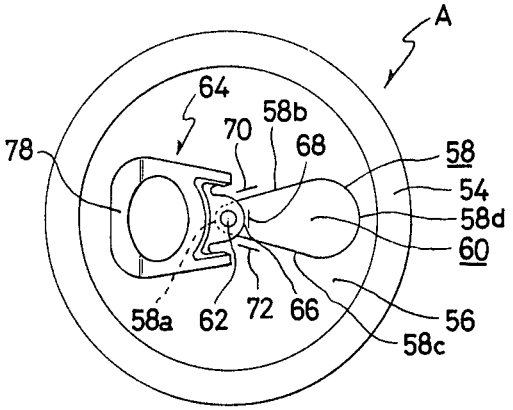
FIG. 9 is a plan view of a can cap (A) according to a first embodiment of this invention.
Figure 10:
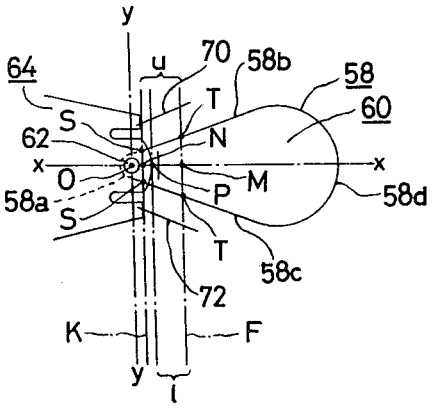
FIG. 10 is an enlarged plan view of the principal part of the can cap (A)
Figure 11:
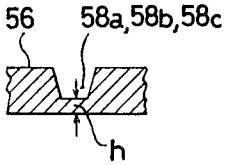
FIG. 11 is an enlarged sectional view of a score residual.

A first embodiment of this invention is described below while referring to FIGS. 9 through 11.

In an easy-open can cap (A) with a ring pull tab according to this invention, on a cap surface (56) surrounded by a curled portion (54) formed in the outer periphery of the can cap there is formed a score (58) and in an endless manner the profile of a deformed ellipse-shaped tear-opening portion (60) containing a small-diameter semicircle portion **(58*a*) and a larger-diameter semicircle portion (58*d*) which are connected together by straight line portions (58*b*) and (58*c*) on both sides. A ring pull tab (64) is secured to the small-diameter semicircle portion (58*a*) of the tear-opening portion (60) with a rivet (62) which projects from the center of the smalll-diameter semicircle portion (58*a*). With the ring pull tab (64) the score (58) can be torn to form an opening. In a predetermined transitional area (u) in which the opening force becomes maximum and which is defined by a starting point (S) and terminal point (T) within both straight line portions (58*b*) (58*c*), the score is formed so as to have a score residual (h) of about 50–60$\mu$, and the score in the area of the small-diameter semicircle portion (58*a*) near the rivet (62) is formed so as to have a score residual of about 60–70$\mu$, while a bending score (68) is formed in the vicinity of a nose (66) of the ring pull tab (64) which is in the form of a circular arc, the bending score (68) meeting at right angles with the tear-opening portion (60)**.

In determining the position of the starting point (S) and that of the terminal point (T) which define the transitional area (u), if an axis of abscissa (x) extending on the larger diameter axis and symmetrically bisecting the tear-opening portion (60) and the ring pull tab (64) and an axis of ordinate (y) extending in the perpendicular direction, which axes cross each other at the central origin (0) of the rivet (62), are taken as coordinate axes and the point at which the tip end of the ring pull tab (64) intersects the axis of abscissa (x) is taken to be a second opening point (P), the portion where the score (58) is most likely to burst at the time of an inversional drop of the can or at the time of hammering and caulking for the rivet (62), when taken into account as a condition for determining the starting point (S), is the area of the small-diameter semicircle portion **(58*a*) near the rivet (62) which undergoes the concentration of stress when the can drops or when the rivet is hammered and caulked, and making the score residual (h) small in the area of the small-diameter semicircle portion (58*a*)** would result in an extremely weakened inversional dropping strength or hammering strength of the can.

Under such a restriction on the bursting strength, the start point (S) must be decided so that it is the intersecting point between a line (K) and both straight line portions **(58*b*) (58*c*), the line (K) passing through a middle point (N) between the central origin (0)** and the second opening point (P) and running parallel with the axis of ordinate (y).

As to the condition for determining the terminal point (T), with the second opening force (kg) taken into account, the distance (l) between the second opening point (P) and a point (M) spaced therefrom on the axis of abscissa (x) requires at least 2 mm for allowing the second opening operation to become fully stable whereby experientially the tear opening force is fully accelerated to make tearing possible by inertia.

Therefore, the terminal point (T) must be determined so that it is at the intersecting point between a line (F) and both straight line portions **(58*b*) (58*c*)**, the line (F) passing through the point (M) selected under such a condition and running parallel with the axis of ordinate (y).

By the ordinary machining method, however, it is impossible to form the score so as to have a score residual (h) of about 50–60$\mu$ in the transitional area (u) which is defined by the so-decided starting point (S) and terminal point (T). Therefore, simultaneously with forming the score (58) there are formed machining aid scores (70) and (72) with a larger score residual (h) in the vicinity of the transitional area (u) the plastic flow phenomenon which is forcibly developed within the metal texture is suppressed as far as possible and the stress generated within the metal is prevented from surpassing the tensile strength of the metal to thereby prevent rupture of the metal, resulting in that the score residual (h) can be reduced to about 50–60$\mu$ which by the ordinary machining method has been unattainable.

Figure 12:
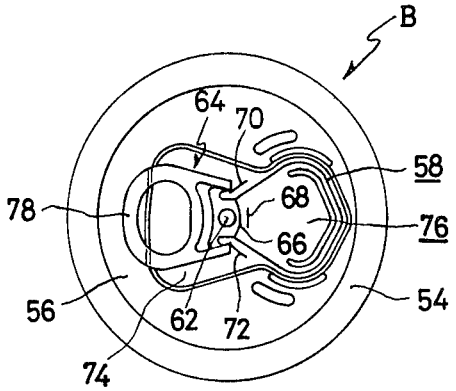
FIG. 12 is a plan view of a can cap (B) according to a second embodiment of this invention.

Although in the embodiment here described the tear-opening portion (60) is in the form of a deformed ellipse, there may be adopted a can cap (B) according to the second embodiment in which, as shown in FIG. 12, a wide fan-shaped tear-opening portion (76) is formed within a recess (74), or a can cap (not shown) in which both straight line portions (58*b*) and (58*c*) form a curvilinear ginkgo leaf-shaped tear-opening portion, or can caps of other shapes. Further, the scores (70) and (72) are not always required to be parallel with both straight line portions (58*b*) and (58*c*).

Figure 13:
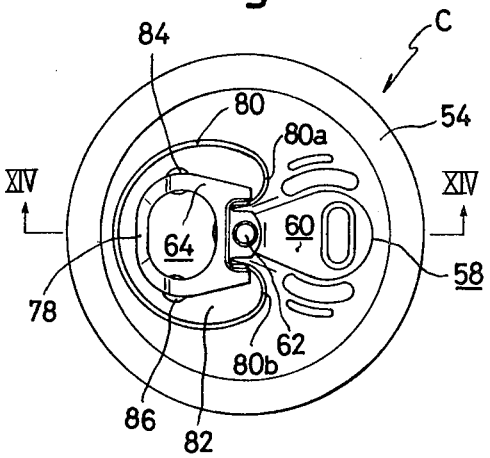
FIG. 13 is a plan view of a can cap (C) according to a third embodiment of this invention.
Figure 14:
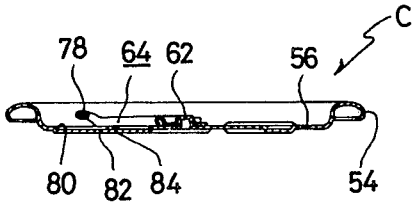
FIG. 14 is a sectional view taken on line XIV—XIV of FIG. 13.

Furthermore rigidity may be imparted to the can surface (56) by adopting a can cap (C) according to the third embodiment in which, as shown in FIGS. 13 and 14, a heart-shaped recess (82) is defined by a stepped portion (80) for facilitating the insertion of a finger in the finger hook (78) of the ring pull tab (64), or projections (84) and (86) are formed which support both sides of the ring pull tab (64).

Figure 1:
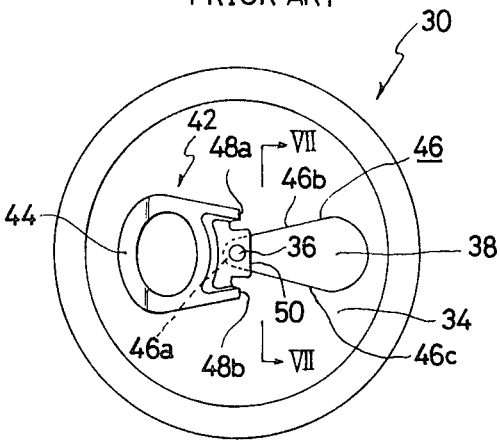
Fig.1 PRIOR ART
FIG. 1 is a plan view of a prior art easy-open can with a ring pull tab.
Figure 4:
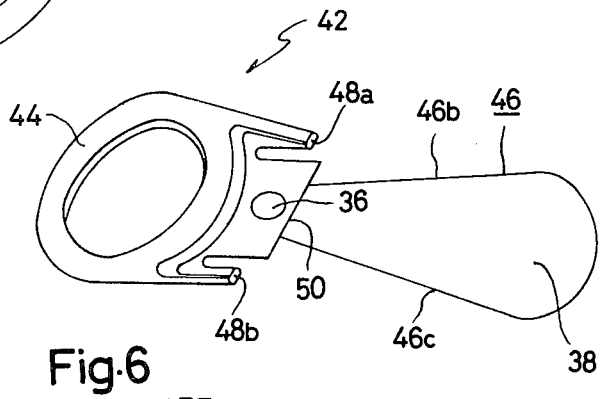
Fig.4 PRIOR ART
FIGS. 4 and 5 stepwise illustrate the initial breaking operation for the tear-opening portion.
Figure 5:
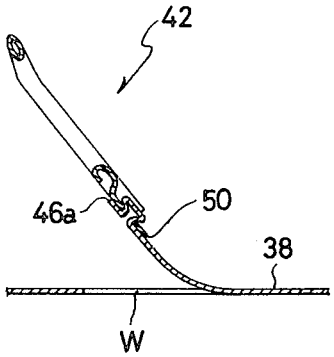
Fig.5 PRIOR ART
Figure 6:
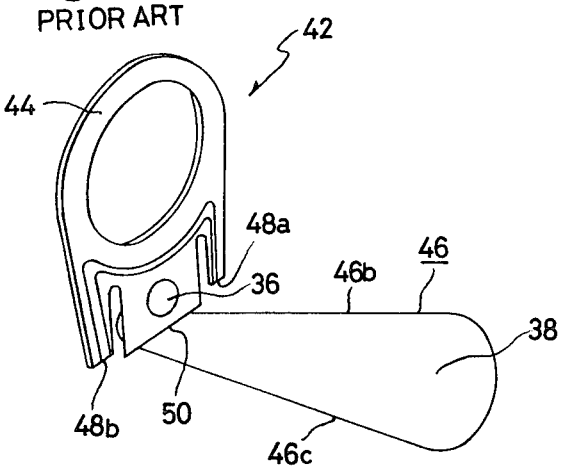
Fig.6 PRIOR ART
FIG. 6 illustrates the second opening operation for the tear-opening portion.
Figure 2:
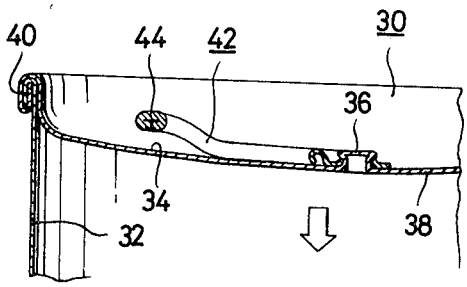
Fig.2 PRIOR ART
FIGS. 2 and 3 are enlarged sectional views of the principal parts of a prior art easy-open can with a ring pull tab in reduced and increased pressure conditions respectively of the can interior.
Figure 15:
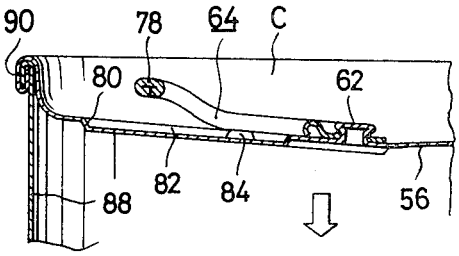
FIGS. 15 and 16 are enlarged sectional views of the can cap (C) respectively in reduced and increased pressure conditions of the can interior.
Figure 3:
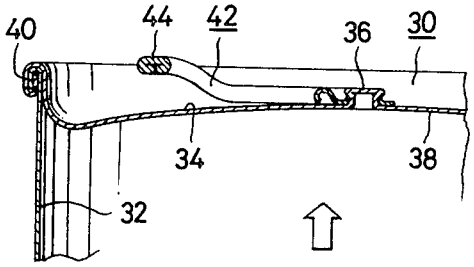
Fig.3 PRIOR ART

Since the can caps (A) through (C) according to this invention are constructed as above, they can be seamed and sealed to a can body (88) while forming a seam band (90) thereon. Particularly in the case of the can cap (C), even when the cap surface (56) curves up and down as illustrated in FIGS. 15 and 16, only the recess (82) defined by the stepped portion (80) maintains a plate-like condition.

The stepped portion (80) has stepped ends (80*a*) and (80*b*) on both sides of the tear-opening portion (60). The stepped ends (80*a*) and (80*b*) are positioned on the same line as the bending score (68) which is formed perpendicular to the axial larger-diameter direction within the tear-opening portion (60), so when the cap surface (56) curves in response to an increase or a decrease of the inside pressure of the can, only the recess (82) assumes a bent state in the position of the bending score (68).

Figure 16:
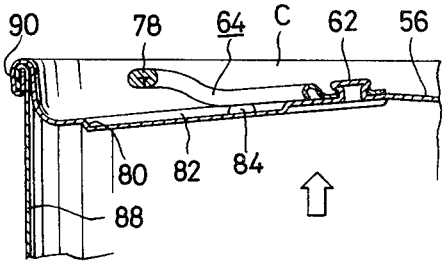
Figure 7:
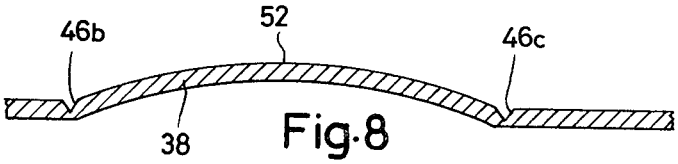
Fig.7 PRIOR ART
FIG. 7 is an enlarged sectional view taken on line VII—VII of FIG. 1 of the tear-opening portion in FIG. 1.
Figure 8:
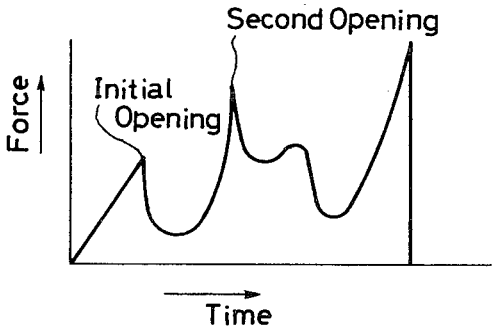
FIG. 8 is a line graph showing the change in opening force with the lapse of time in the opening operation for the tear-opening portion.

When the inside pressure of the can increases at the time of heat-sterilization after the can cap (C) is sealed to the can body, an action is exerted on the cap surface (56) whereby, as illustrated in FIG. 16, the cap surface (56) tries to curve upwardly while as a whole describing a gentle circular arc with the rivet (62) as the vertex. Against this action, since the bending score (68) is formed near the end of the nose (66) of the ring pull tab (64) and further the recess (82) tries to maintain its plate-like condition, the cap surface (56) curves in the tear-opening portion (60) on the side of the larger-diameter semicircle portion (58*d*) from the bending score (68), while the recess (82) on the side of the ring pull tab (64) from the bending score (68), raises the position of the rivet (62) while maintaining its plate-like condition, as is illustrated in FIG. 16. As a result, the position of the rivet (62) becomes highest, from which the recess (82) inclines rectilinearly downward so becomes lower.

Consequently, the finger hook (78) of the ring pull tab (64) positioned within the recess (82) is positioned low and, as shown in FIG. 16, it never becomes higher than the seam band (90). Thus the can cap (C) of this invention is advantageous in that, even when the cap surface (56) curves upwardly as a result of an increase in the inside pressure of the can at the time of heat-sterilization, there is no fear of the finger hook (78) becoming higher than the seam band (90), so the troubles so far encountered do not occur.

On the other hand, when the inside pressure of the can drops on cooling after heat-sterilization resulting in the cap surface (56) curving downwardly, the cap surface (56), as illustrated in FIG. 15, curves in the tear-opening portion (60) on the side of the larger-diameter semicircle portion (58*d*) from the bending score (68), while the recess (82) on the side of the ring pull tab (64) from the bending score (68) lowers the position of the rivet while maintaining its plate-like condition, so that the rivet (62) is positioned lowest, from which the recess (82) becomes higher rectilinearly. Consequently, the space between the finger hook (78) of the ring pull tab (64) positioned within the recess (82) and the upper surface of the recess 882) does not become narrower despite of the downward curving of the cap surface (56). Thus the can cap of this invention is advantageous in that, when the cap surface (56) curves downwardly due to a reduction in the inside pressure of the can, the finger hook (78) does not approach the cap surface (56), so the finger tip for pulling up the ring pull tab (64) can be easily inserted into the space below the finger hook (78).

Also in the other can caps (A) and (B) there can be expected about the same effect as that of the cap (C).

In the case of the can cap (A), since there is not formed such a recess (82) as in the cap (C), the cap surface (56) curves in the shape of an arc on both sides of the bending score (68) which has been displaced to either the highest or lowest position according to the inside pressure of the can. In the case of the can cap (B), since there exists the recess (74) as a rigid portion, the cap surface (56) inclines rectilinearly on both sides of the bending score (68) which has been displaced to either the highest or lowest position according to the inside pressure of the can.

Figure 17:
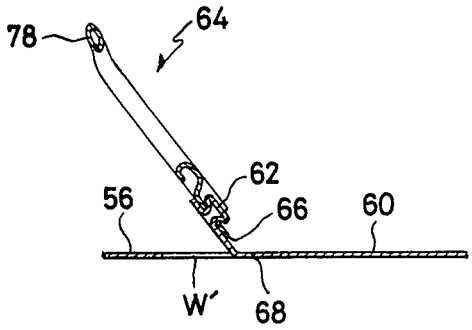
FIG. 17 is a longitudinal sectional view thereof showing the opening operation.

In this invention, moreover, the bending score (68) is formed near the nose (66) of the ring pull tab (64) and in the ridge or central part of the tear-opening portions (60) and (76) so as to meet at right angles with the axial larger-diameter direction of the tear-opening portions (60) and (76), so that the portion in the vicinity of the bending score (68) cancels the ridge (52) and becomes flat and, when the finger hook (78) of the ring pull tab (64) is pulled up with a finger, the tab (64) can be bent easily with a small initial opening area (W') as shown in FIG. 17 in the position of the bending score (68) formed within the tear-opening portions (60) and (76).

Thus, the initial opening area becomes smaller and inevitably the force required to cause an initial breakage also becomes smaller than in can caps not having the bending score (68), and consequently the force required to pull up the ring pull tab (64) becomes 1.5 to 2.0 kg.

Figure 18:
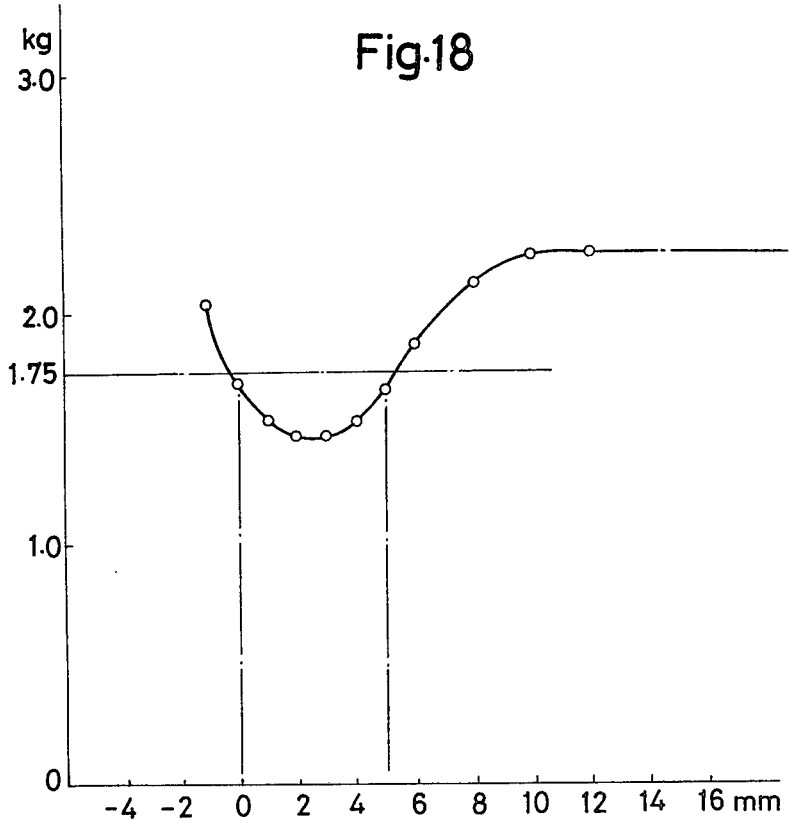
FIG. 18 is a graph of data on the relation between the initial opening force and the score position.

If the bending score (68) is formed on the ridge and spaced more than 5 mm from the nose (66) of the ring pull tab (64), the initial breaking force becomes large, making no great difference from conventional can caps of this sort, as can be seen from FIG. 18 which shows the relation between the force (kg) required for the initial opening and the spacing (mm) between the score (68) and the nose (66).

Therefore, in the case of forming the score (68) in the tear-opening portions (60) and (76) defined by the score (58), it must be formed within 5 mm from the nose (66) of the ring pull tab (64), otherwise the effect thereof cannot be expected.

In this invention, moreover, the nose (66) of the ring pull tab (64) is formed in the shape of a circular arc, so at the time of the initial breakage of the small-diameter semicircle portion (58*a*) the pulling-up force with a finger for the ring pull tab (64) is concentrated on the tip end of the nose (66) and consequently functions to promote the bending of the bending score (68) whereby the shift to the second opening operation can be done smoothly.

Figure 19:
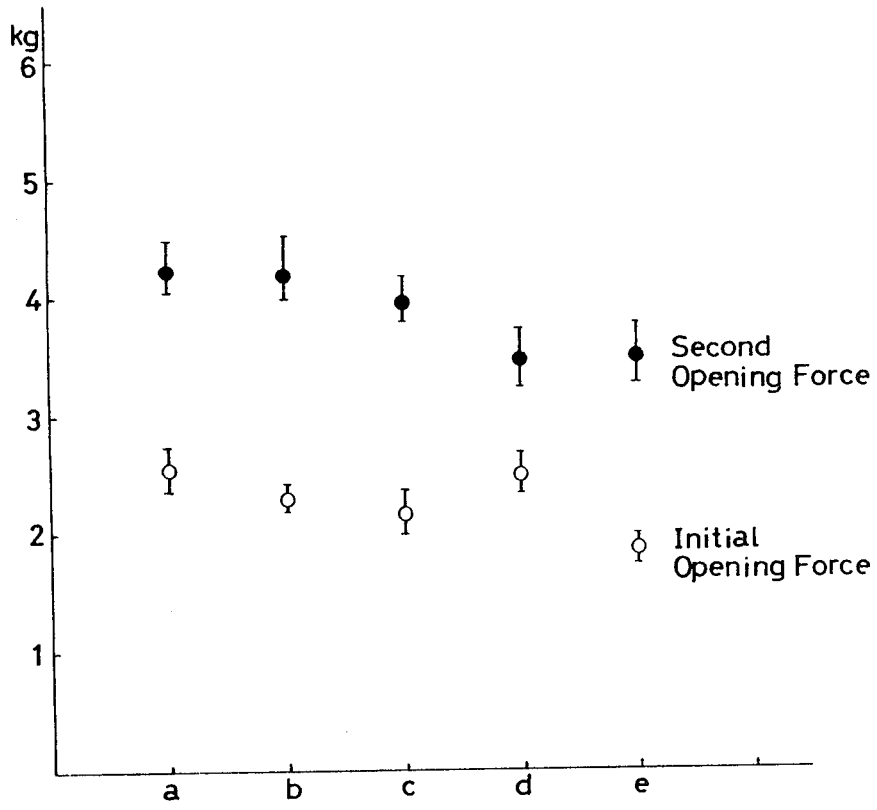
FIG. 19 is a graph of data comparing the initial and second opening forces with respect to a conventional product (a), the case of score (68) alone (b), the case of a circular arc-shaped nose (c), the case of auxiliary scores (70) (72) alone (d) and the product of this invention (e).

The data graph of FIG. 19 could be obtained by making a comparison test between the initial opening force and the second opening force for the tear-opening portions (60) and (76) with respect to a prior art product (a), the case where the bending score (68) alone was formed (b), the case where the nose (66) alone of the ring pull tab (64) was formed (c), the case where the auxiliary scores (70) and (72) alone were formed (d), and the product of this invention (e), provided that the can caps tested were 0.23 mm thick and had the score (58) of a score residual (h) of 60–70$\mu$.

From the graph of FIG. 19 it is proved that the opening characteristics of the product of this invention are improved to a great extent.

What we claim is:

1. An easy open can cap comprising an elongated tear strip defined by a main score, a ring pull tab attached to a starting end portion of said tear strip by a rivet, said main score having a starting end portion extending partially around the area of said rivet and a terminating end portion at the opposite end of said tear strip, said main score also having transitional portions between said starting end portion and said terminating end portion, said transitional portions having a thinner score residual than that of said starting end portion, and auxiliary scores on said can cap having score residual greater than that of said main score, said auxiliary scores being spaced from said transitional portions, said auxiliary scores being formed in said can cap at the same time that said main score is being formed to thereby make it possible to have said score residual of said transitional portions less than the score residual of said starting end portion.

2. An easy-open can cap according to claim 1, further comprising a bending score on said tear strip which extends perpendicular to the longitudinal axis of said tear strip, said tear strip bending on said bending score during initial opening of said tear strip.

3. An easy-open can cap according to claim 1, wherein said auxiliary scores are parallel to said transitional scores.

4. An easy-open can cap according to claim 2, wherein said ring pull tab has a semi-circular nose portion to operate as a fulcrum when said ring pull tab is lifted relative to the can cap to initiate opening of the can.

5. An easy-open can cap according to claim 4, wherein an abscissa is defined by a line longitudinally bisecting said tear strip and an ordinate is defined by a line passing through the center of said rivet and extending perpendicular to said abscissa, said transitional score having one terminating end on a line parallel to said ordinate and passing through the midpoint between the center of said rivet and the point at which the end of said nose intersects said abscissa.

6. An easy-open can cap according to claim 5, wherein the other terminating end of said transitional score is on a line parallel to said ordinate and passing through a point on said abscissa located between said bending score and said terminating end portion of said tear strip.

7. An easy-open can cap according to claim 4, wherein said line parallel to said ordinate and passing through said other terminating end of said transitional score passes through a point on said abscissa located at least 2 mm from the point at which the end of said nose intersects said abscissa.

8. An easy-open can cap comprising an elongated tear strip defined by a main score, said main score having a transitional portion having a thinner score residual than that of the remainder of said main score, a ring pull tab attached to a starting end portion of said tear strip by a rivet, said ring pull tab having a semi-circular nose portion to operate as a fulcrum when said ring pull tab is lifted relative to the can cap to initiate opening of the can, an abscissa defined by a line longitudinally bisecting said tear strip and an ordinate defined by a line passing through the center of said rivet and extending perpendicular to said abscissa, said transitional score having one terminating end on a line parallel to said ordinate and passing through the midpoint between the center of said rivet and the point at which the end of said nose intersects said abscissa, said transitional score having the other terminating end on a line parallel to said ordinate and passing through a point on said abscissa which is spaced from the point at which the end of said nose intersects said abscissa a distance sufficient for the second opening operation to become fully stable, and a bending score on said tear strip near said rivet, said bending score extending perpendicular to a longitudinal center line of said tear strip so that when the ring pull tab is initially lifted, said tear strip bends at said bending score to thereby reduce the applied force necessary for initiating opening of said tear strip.

* * * * *